United States Patent [19]

Miyakawa et al.

[11] 4,168,329

[45] Sep. 18, 1979

[54] AUTO-BIAS DEVELOPING PROCESS AND AN ELECTROPHOTOGRAPHIC COPYING MACHINE

[75] Inventors: Seiichi Miyakawa, Nagareyama; Akira Midorikawa, Yokohama; Susumu Tatsumi, Kawasaki; Youtarou Kakitani; Toyoo Okamoto, both of Yokohama; Sakae Ota; Kenji Kojima, both of Tokyo, all of Japan

[73] Assignee: Ricoh Co., Ltd., Tokyo, Japan

[21] Appl. No.: 725,877

[22] Filed: Sep. 23, 1976

[30] Foreign Application Priority Data

Oct. 1, 1975 [JP] Japan ..... 50-119049

[51] Int. Cl.[2] ..... G03G 13/10; G03G 15/10

[52] U.S. Cl. ..... 427/8; 118/647; 118/653; 118/662; 324/72; 355/10; 355/14; 427/14; 427/17; 118/706

[58] Field of Search ..... 427/8, 15, 17, 14; 324/72; 118/7, 9, 662, 647–651; 355/10, 14; 96/1 LY, 1 SD

[56] References Cited

U.S. PATENT DOCUMENTS

| | | | |
|---|---|---|---|
| 3,877,413 | 4/1975 | Rowell et al. | 118/647 X |
| 3,892,481 | 7/1975 | Schaefer et al. | 324/72 X |
| 3,981,267 | 9/1976 | Gardiner | 355/10 X |
| 4,025,184 | 5/1977 | Mochizuki | 427/17 X |

*Primary Examiner*—John D. Smith
*Assistant Examiner*—Stuart D. Frenkel
*Attorney, Agent, or Firm*—Cooper, Dunham, Clark, Griffin & Moran

[57] ABSTRACT

An auto-bias developing process for developing an electrostatic latent image formed on a photosensitive member which includes the step of storing a detected potential in order to apply a fixed bias potential to a developing electrode plate wherein the surface potential of a photosensitive member is detected through a developing solution by a sensor electrode, and is stored in a memory circuit for subsequent conversion to a fixed bias potential which corresponds to the detected potential and is applied to the developing electrode. The process also includes the step of removing any toner which attaches to the developing electrode plate, by the application of a reverse bias potential thereto when the developing process is not taking place and the step of rendering the developing electrode plate electrically floating for removing toner from the plate and preventing deposition of toner onto the surface of the photosensitive member.

6 Claims, 4 Drawing Figures

AUTO-BIAS DEVELOPING PROCESS AND AN ELECTROPHOTOGRAPHIC COPYING MACHINE

BACKGROUND OF THE INVENTION

The invention relates to an auto-bias developing process in an electrophotographic copying machine in which the surface potential of a photosensitive member having an electrostatic latent image formed thereon is detected by a detecting electrode through the interposition of a developer having a relatively low resistance and is utilized to determine, by an operational amplifier, a bias potential suitable to prevent a copy from scumming, which bias potential is applied to a developing electrode plate.

In the prior art, the detection of the potential of a latent image formed on a moving photosensitive member without contact therewith presented a considerable difficulty. For example, the weak electric field of the image must be accurately sensed and amplified with a high amplification factor and with an increased rate of response. For the most part, these problems have been successfully solved by the use of a developer having a relatively low resistivity (less than $10^{13}\Omega-cm$) to facilitate the detection of the potential of the latent image, and by improving the performance of the amplifier used. However, the auto-bias developing process developed thus far leaves much to be improved. For example, although a bias potential is applied to the developing electrode plate in accordance with the potential of the latent image formed, the originals to be reproduced such as the documents used for forming the latent image, vary widely, so that it is extremely difficult to produce a copy image free from scumming and of equal quality among the varying originals. Rather, it is recognized that copy images of a high quality and a uniform gradation can better be produced by employing a fixed bias potential rather than using the auto-bias which varies with the potential of the latent image.

SUMMARY OF THE INVENTION

The process according to the invention includes the steps of detecting the surface potential of a photosensitive member by a detecting electrode which operates through a developer, storing the detected potential in a memory, and applying a fixed bias potential to a developing electrode plate in accordance with the stored potential. The detecting electrode is located adjacent to the surface of the photosensitive member and detects an average potential in an area of the latent image ranging several tens of millimeters from the leading edge thereof. The detected potential is used to charge a capacitor through a resistor thus storing it in a memory circuit. Subsequently, the memory circuit is opened and the detected potential which is maintained at this stored value is amplified to be applied as a fixed bias potential to the developing electrode plate. Also included is the step of applying a bias potential of the reverse polarity to the developing electrode plate except during the developing step, thereby removing any toner which attaches thereto. Background smearing or scumming is prevented by causing toner which tends to attach to the background to deposit on the developing electrode plate. As the amount of toner which attaches to the electrode plate increases, the biasing effect is decreased, which must be compensated for by removal of the deposited toner. Accordingly, the process also includes the step of rendering the developing electrode plate electrically floating or applying a corresponding potential thereto at the termination of the copying operation for removing toner from the electrode plate and also preventing the deposition of toner onto the surface of the photosensitive member. When the electrode plate is made electrically floating, the surface potential of the electrode plate is maintained substantially equal to the surface potential of the photosensitive member, whereby toner attaching to the electrode plate is released.

Therefore, it is an object of the invention to provide an improved auto-bias developing process of developing an electrostatic latent image formed on a photosensitive member.

It is another object of the invention to provide a developing process of the kind described which permits a fixed bias potential to be applied to the developing plate in order to obtain an image of a uniform gradation.

It is a further object of the invention to provide a developing process of the kind described which permits a bias potential of reverse polarity to be applied to the developing electrode plate to remove any toner which attaches thereto.

It is still another object of the invention to provide a developing process of the kind described in which the developing electrode plate can be made electrically floating or a corresponding potential applied thereto in order to prevent the toner from remaining on the surface of the photosensitive member and of the developing electrode plate at the termination of a copying operation.

The above and other objects of the invention will become more apparent as the description proceeds with respect to the attached drawings.

DETAILED DESCRIPTION OF PREFERRED EMBODIMENT

Figure 1:
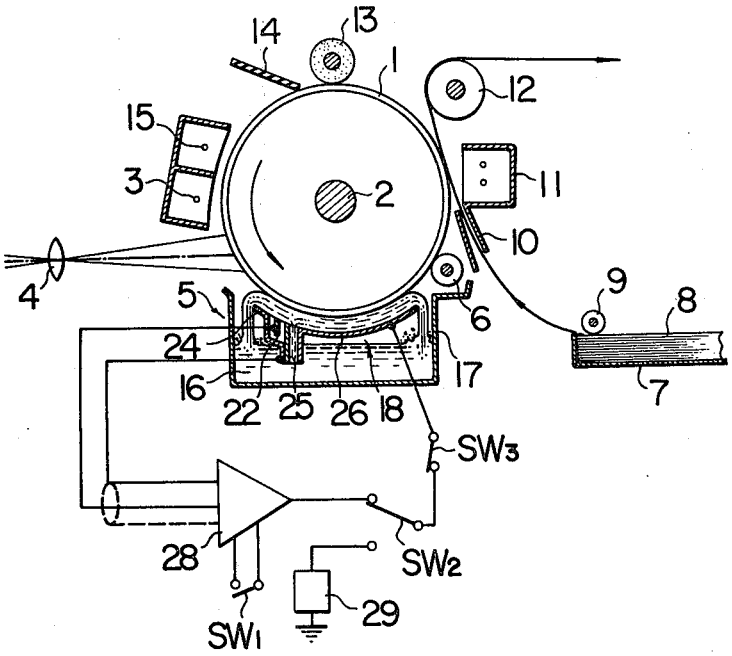
FIG. 1 is a schematic diagram of an electrophotographic copying machine of wet type to which the invention is applied.

Referring to FIG. 1, there is schematically shown an electrophotographic coying machine of wet type to which the invention is applied in a preferred form. A photosensitive drum 1 having a photosensitive layer of selenium on its surface is mounted on a shaft 2 for rotation at a uniform rate in a direction indicated by an arrow. During the rotation, the drum surface is uniformly charged by a primary corona discharger 3. An image of an object being copied is projected through an exposure optical system 4 onto the surface of the photosensitive member, whereby the charge on the drum surface is selectively removed, forming an electrostatic latent image thereon.

The latent image formed is then converted into a visual image by a developing device 5, which will be described in detail later. After the developing of the latent image, an excess amount of developing solution which remains on the surface of the photosensitive member is scraped off by a squeeze roller 6. A transfer sheet 8 is supplied from a stack contained in a receptacle 7, by a feed roller 9 to move through a transfer sheet guide 10, and then brought into superimposed relationship with the visual image formed on the drum surface. A transfer corona discharger 11 applies a corona discharge to the back surface of the transfer sheet to transfer the visual image onto the transfer sheet. The transfer sheet having the visual image transferred thereto is separated from the drum surface, and is delivered by an exit roller 12 to a given position. The photosensitive member 1 continues to rotate and passes under a cleaning roller 13 and a cleaning blade 14, both of which serve to remove any residual toner therefrom. The member 1 is also subjected to a discharge by a corona discharger 15 for the elimination of any remaining electric potential. This completes one copying cycle.

Figure 2:
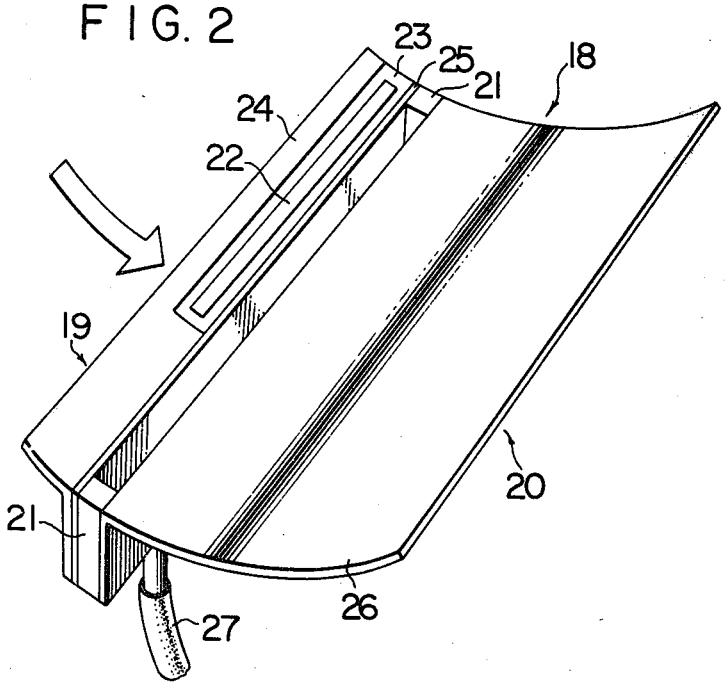
FIG. 2 is a perspective view of a developing dishplate which is used in the apparatus of FIG. 1.

Considering the developing device 5 in more detail, it comprises a tank 17 containing a quantity of a developing solution 16, and a developing dishplate 18 having its top surface located adjacent to and in conformity to the peripheral surface of the photosensitive member 1. As shown in perspective in FIG. 2, the developing dishplate 18 comprises a sensor electrode assembly 19 and a developing electrode assembly 20, which are separated from each other by molded insulating spacers 21 which provide an electrical insulation therebetween. The sensor electrode assembly 19 is located nearer the entrance end of the photosensitive member, and includes an electrically conductive sensor electrode 22 which extends from one end to the central region of the top surface thereof, and a pair of electrically interconnected conductive guard electrodes 24, 25 disposed in a manner surrounding the sensor electrode 22, with a molded insulator 23 interposed between the electrode 22 and the electrodes 24, 25. The developing electrode assembly 20 comprises a single conductive electrode plate 26. A supply tube 27 communicates with the space defined by the pair of spacers 21 for supplying a developing solution to the region above the developing dishplate through such space. As shown in FIG. 1, the sensor electrode 22 and the guard electrodes 24, 25 are connected with the inputs of an operational amplifier 28, which incorporates a memory having a switch SW1 associated therewith for opening or closing the circuit thereof. The output of the operational amplifier 28 is connected with one of the stationary contacts of a switch SW2, while the other stationary contact is connected with a voltage source 29 for reverse bias. The movable contact of the switch SW2 is connected with a stationary contact of another switch SW3 having its movable contact connected with the developing electrode plate 26.

An average potential of the latent image formed on the photosensitve member is detected by the sensor electrode 22 through the intervening developer, and as it is supplied to the operational amplifier 28, a bias potential higher than the potential of the background is calculated in accordance with the detected potential and is fed through the switches SW2, SW3 to the developing electrode plate so as to assure a copy image free from background smearing or scumming.

The sensor electrode 22 has a dimension which is determined in accordance with the minimum copy size desired from the copying machine, the speed of response of the operational amplifier, and the area across which the average value of the potential on the latent image is taken. The sensor electrode 22 is surrounded by the guard electrodes 24 and 25 with the molded insulator 23 interposed therebetween, because but for these guard electrodes, a potential difference will be created between the developing electrode plate 26 and the sensor electrode 22, which, when viewed from the operational amplifier 28, produces a feedback circuit from the developing electrode 26 to the sensor electrode 22 through the low resistance developer, thus making the sensor electrode incapable of faithfully detecting the potential of the latent image on the photosensitive member.

In the present embodiment, the photosensitive member has a photoconductive, insulating layer of selenic material, so that the charge which forms the latent image has a positive polarity. The background of an object being copied is generally of a white or other pale color, and accordingly the background region of the photosensitive layer should have a potential which is close to zero. However, as a result of a fatigue of the photosensitive layer, a background potential which may be as high as 100 to 300 volts may remain. Thus, in order to assure a copy image free from scumming, it is necessary to apply a bias potential of higher magnitude than the background potential and of the same polarity, that is, positive polarity in the present instance, to the developing electrode plate in order to attract the toner in the developing solution toward the developing electrode plate. Obviously, it is also possible to prevent scumming of the copy by increasing the opening in a diaphragm which is used to adjust the amount of exposure during the exposure step to thereby reduce the potential in a background region of the photosensitive member, but a fine adjustment of the amount of exposure represents a very complex process which is not advisable.

In the auto-bias developing process according to the invention, the potential of the latent image is detected through a developer of a relatively low resistance and the detected potential amplified to produce a bias potential which at least exceeds the background potential for application to the developing electrode plate, so that a copy image free from scumming can be obtained without requiring an adjustment of the exposure controlling diaphragm. Consequently, a single stage fixed diaphragm is sufficient for the purpose of the invention. However, it is desirable to use a three-stage fixed diaphragm in order to assure a copy image free from scumming for all varieties of objects being copied.

Figure 3:
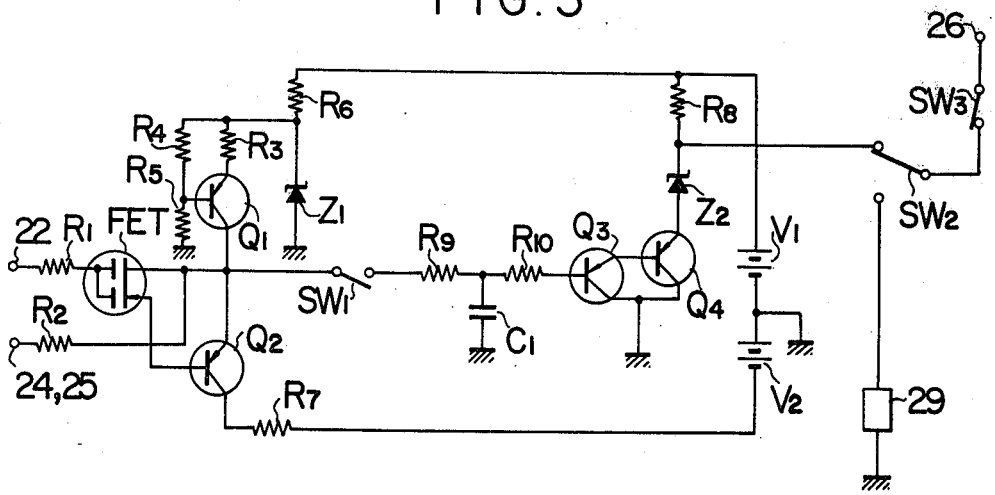
FIG. 3 is a circuit diagram of the apparatus shown in FIG. 1.

FIG. 3 shows an electrical circuit diagram of the invention. The sensor electrode 22 is connected through a resistor R1 with the gate electrode of MOS field effect transistor FET, which has its drain electrode connected through a resistor R2 with the guard electrodes 24, 25. A PNP transistor Q1 has its emitter electrode connected with the ground through resistors R3, R4 and R5 connected in series, with the junction between the resistors R4 and R5 connected with the base of the transistor Q1. The junction between the resistors R3 and R4 is connected through a resistor R6 with the positive terminal of a d.c. power source V1 and is also connected with the cathode of a Zener diode Z1, the anode of which is connected with the ground. The junction between the resistor R6 and the power source V1 is connected with one end of a resistor R8, the other end of which is connected with one stationary contact of the reverse bias switch SW2. The collector of the transistor Q1 is connected with the emitter of another transistor Q2 and also connected with the drain electrode of the transistor FET. The base of the transistor Q2 is connected with the source electrode of the transistor FET while its collector is connected through a resistor R7 with the negative terminal of another d.c. power source V2. The positive terminal of the power source V2 is connected with the negative terminal of the power source V1, with the junction therebetween connected with the ground.

The drain electrode of the transistor FET is also connected with the base of a transistor Q3 through a series path including a memory switch SW1 and resistors R9 and R10, with the junction between the resistors R9 and R10 being connected with the ground through a capacitor C1. The transistor Q3 has its emitter connected with the base of a transistor Q4 and has its collector connected with the ground together with the collector of the transistor Q4. The emitter of the transistor Q4 is connected with the anode of a Zener diode Z2, the cathode of which is connected with the resistor R8 and also to said one stationary contact of the reverse bias switch SW2. The reverse bias switch SW2 has its other stationary contact connected with a reverse bias source 29, the opposite terminal of which is connected with the ground. The movable contact of the switch SW2 is connected with the developing electrode plate 26 through the floating switch SW3.

The average potential of the latent image is detected by the sensor electrode 22 having an external resistance which, despite the presence of a low resistance developing solution is as high as several hundred to several thousands of megohms. This means that the amplifier circuit must have a very high input impedance. In the present embodiment, the connection of the output from the sensor electrode with the gate electrode of MOS transistor FET serves this purpose. It will be appreciated that with such a high impedance sensor electrode, any small current causes a change in the detected potential. For this reason, the detected potential is stabilized by connecting the guard electrodes 24, 25 with the output side or the drain of the MOS transistor which assumes substantially the same potential as the sensor electrode.

Though a copying machine is generally designed to image an object being copied by an optical scanning and to form a developed image with the developer, it is to be understood that originals or objects to be copied have a varying degree of image area, which makes it difficult to determine a bias to be applied to the developing electrode plate in accordance with a value detected by a detector. As mentioned previously, a high image quality of uniform gradation is rather assured by the application of a fixed bias. For this reason, an average potential of the latent image over an area thereof ranging a distance of several tens of millimeters from the leading edge thereof is detected, and a corresponding bias potential of a fixed magnitude is applied to the developing electrode plate in order to assure a high image quality of uniform gradation.

To this end, the memory switch SW1 is held closed during the travel of the latent image over a distance of several tens of millimeters from the leading edge, and during such time, the potential detected by the sensor electrode is fed to the MOS transistor FET. A potential corresponding to the input to the transistor FET is utilized to charge the memory capacitor C1 through the resistor R9. The voltage to which the capacitor C1 is charged varies with a variety of latent images, the inherent resistance of the developing solution, the width of the sensor electrode 22 and the time constant formed by the capacitor C1 and resistor R9, all of which can be suitably chosen to provide an appropriate overall response for storing an average potential on the capacitor C1. The memory switch SW1 is opened when the latent image has passed a distance of several tens of millimeters from its leading edge, and subsequently the stored value across the capacitor C1 that is, the potential reached immediately before the switch is opened, is maintained for a further amplification.

The transistors Q1, Q2 and the resistors R3, R4 and R5 serve to maintain a constant current providing an impedance coversion between the input or gate and the output or drain of the MOS transistor FET. The transistors Q3 and Q4 are connected in a Darlington configuration, and therefore the emitter of the transistor Q4 assumes the same potential as the potential to which the capacitor C1 is charged. The Zener diode Z2 serves to add a Zener potential to the detected potential, as represented by the following equalities:

$$V_S \approx V_D$$

$$V_E \approx V_D + V_{Z2}$$

where $V_S$ represents an average potential of the latent image on the photosensitive member, $V_D$ the potential detected by the sensor electrode, $V_E$ the developing bias potential or the output voltage from the operational amplifier and $V_{Z2}$ the Zener voltage.

While copies free from scumming can be obtained with this auto-bias developing process, still when the machine is used for a prolonged period of time, a toner deposition on the developing electrode plate occurs to an extent such that an increased amount of black spots are formed on the copy image to degrade its image quality. In the present embodiment, such disadvantage is overcome by providing the reverse bias switch SW2 between the output of the operational amplifier and the developing electrode plate to connect the reverse bias source 29 (which is a negative potential of about 400 volts since a selenium photosensitive member is used in the present embodiment) with the developing electrode plate 26 through the switch SW3 during a given time interval when no developing process takes place. In this manner, any toner which attaches to the developing electrode plate during the developing process is removed during a given time interval outside the developing process (which is chosen as a time interval intermediate the successive copying operations in the present embodiment), by applying a reverse bias potential which causes a movement of the toner in a direction toward the photosensitive member.

By operating the bias switch SW2 to apply the auto-bias and the reverse-bias to the developing electrode plate during respective time intervals in coordinated relationship with the copy cycle, a marring by the toner of the developing electrode plate is completely eliminated. In an experiment conducted by the inventors, such favorable results by the auto-bias action have been ascertained as a high quality copy free from scumming which has been obtained after producing 30,000 copies.

Now turning to the float switch SW3, the purpose of this switch is to maintain a clean condition of the photosensitive member at the end of a copying operation when it comes to a stop. The cleaning is performed in order to prevent or reduce a firm bonding of the toner with the cleaning member or squeeze roller which is in contact with the photosensitive member.

When all of the corona dischargers are turned off at the termination of a copying operation, the float switch SW3 is opened to render the developing electrode plate electrically floating while the photosensitive member is caused to rotate idly for a period equal to or greater than one second. This ensures that the photosensitive member will be stopped without any accompanying significant deposition of the toner thereon. The deposition of toner on the developing electrode is also prevented because the electrode plate is completely floating in the electrical sense, assuming approximately the same potential as the residual latent image on the photosensitive member. The floating function after the termination of a copying operation can also be achieved by applying a bias potential to the developing plate which is of the same magnitude as that occurring when floating. In addition, a floating potential near zero may be maintained provided a certain compromise is acceptable. To this end, the float switch SW3 may be connected with a different power source or connected with a different circuit.

Figure 4:
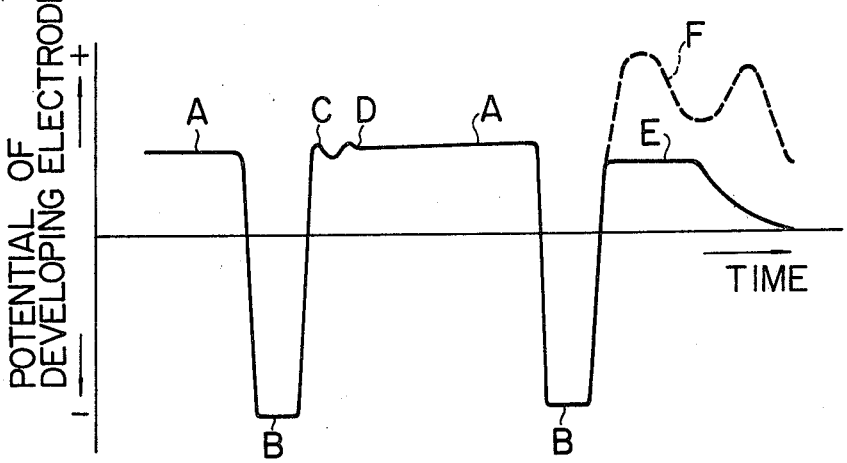
FIG. 4 graphically shows a variation of the potential of the developing electrode plate during a copying cycle.

FIG. 4 graphically shows a variation in the potential of the developing electrode plate at the end of a copying operation in the embodiment described above. A curve portion A represents the potential prevailing when the fixed bias is applied, portion B the potential when the reverse bias is applied, portion C the potential at the commencement of a final copy, portion D the potential when the signal input to the memory is turned off, portion E the potential during the floating condition, and portion F the potential during the application of the floating potential. It is believed that the curve clearly demonstrates the effect achieved with the invention.

While a liquid developer is used in the embodiment described above, it should be understood that the invention is equally applicable where a powder developer is employed. The arithmetic unit comprises a simple summation circuit in the embodiment, but may comprise any other form of circuit performing an arithmetic operation. Additionally, an associated protective circuit may be utilized.

What is claimed is:

1. In an auto-bias developing process in an electrophotographic copying machine comprising the steps of:

detecting at the beginning of each developing step during a copying operation the surface potential of a rotating photosensitive member having an electrostatic latent image formed thereon through a developer having a relatively low resistance;

determining a bias potential in accordance with the detected potential during each developing step for application to a developing electrode plate;

supplying the detected potential during each developing step to a memory for storage; and applying a fixed bias potential which is determined on the basis of the stored potential to the developing electrode plate during each developing step for producing a copy free from scumming; and applying a bias potential of opposite polarity to that of said fixed bias potential to the developing electrode plate for a given time interval at the end of a copying operation for preventing any toner from remaining deposited on the developing electrode plate;

the improvement comprising the further step of:

rendering the developing electrode plate electrically floating following said given time interval at the end of a copying operation while rotating the photosensitive member in a brief idle operation for preventing any toner from becoming deposited on the surface of the photosensitive member and the developing electrode plate after the cessation of copying.

2. In an auto-bias developing process in an electrophotographic copying machine comprising the steps of:

detecting at the beginning of each developing step during a copying operation the surface potential of a rotating photosensitive member having an electrostatic latent image formed thereon through a developer having a relatively low resistance;

determining a bias potential in accordance with the detected potential during each developing step for application to a developing electrode;

supplying the detected potential during each developing step to a memory for storage;

applying a fixed bias potential which is determined on the basis of the stored potential to the developing electrode during each developing step for producing a copy free from scumming; and applying a bias potential of opposite polarity to that of said fixed bias potential to the developing electrode for a given time interval at the end of a copying operation for preventing any toner from remaining deposited on the developing electrode;

the improvement comprising the further step of:

applying a potential to the developing electrode, following said given time interval at the end of a copying operation, corresponding to the potential of the residual latent image on the photosensitive member while rotating the photosensitive member in a brief idle operation for preventing any toner from becoming deposited on the surface of the photosensitive member and the developing electrode.

3. An electrophotographic apparatus of the type comprising:

a rotatable photosensitive member having a surface on which electrostatic latent images are formed and then developed by means of a developer having a relatively low resistance;

a developing electrode for creating a bias potential adjacent said photosensitive member during each developing step;

sensor means for detecting through said developer the surface potential of said photosensitive member when an electrostatic latent image is formed thereon;

memory means for storing the potential detected by said sensor means at the beginning of each development step during a copying operation;

means for applying a fixed bias potential to said developing electrode in accordance with the stored potential during each developing step for producing a copy free from scumming; and means for applying a bias potential, of opposite polarity to said fixed bias potential, to the developing electrode at the end of a copying operation for preventing any toner from remaining deposited on the developing electrode;

wherein the improvement comprises:

means for subsequently rendering the developing electrode electrically floating at the end of a copying operation while the photosensitive member is rotating in a brief idle operation for preventing any toner from becoming deposited on the surfaces of the photosensitive member and the developing electrode after the cessation of copying.

4. An apparatus as in claim 3 wherein said memory means comprises a FET and a capacitor.

5. An electrophotographic apparatus of the type comprising:

a rotatable photosensitive member having a surface on which electrostatic latent images are formed and then development by means of a developer having a relatively low resistance;

a developing electrode for creating a bias potential adjacent said photosensitive member during each development step;

sensor means for detecting through said developer means the surface potential of said photosensitive member when an electrostatic latent image is formed thereon;

memory means for storing the potential detected by said sensor means at the beginning of each development step during a copying operation;

means for applying a fixed bias potential to said developing electrode in accordance with the stored potential during each developing step for producing a copy free from scumming; and means for applying a bias potential, of opposite polarity to said fixed bias potential, to the developing electrode at the end of a copying operation for preventing any toner from remaining deposited on the developing electrode;

wherein the improvement comprises:

means for subsequently applying a potential to the developing electrode at the end of a copying operation corresponding to the potential of the residual latent image on the photosensitive member, while rotating the photosensitive member in a brief idle operation for preventing any toner from becoming deposited on the surfaces of the photosensitive member and the developing electrode.

6. An apparatus as in claim 5 wherein said memory means comprises a FET and a capacitor.

* * * * *